US008714578B2

(12) United States Patent
Marechal et al.

(10) Patent No.: US 8,714,578 B2
(45) Date of Patent: May 6, 2014

(54) SAFETY BINDING FOR SKI TOURING

(75) Inventors: Laurent Marechal, Villaz (FR); Jean-François Merino, Epagny (FR)

(73) Assignee: Salomon S.A.S., Metz-Tessy (FR)

( * ) Notice: Subject to any disclaimer, the term of this patent is extended or adjusted under 35 U.S.C. 154(b) by 327 days.

(21) Appl. No.: 13/112,561

(22) Filed: May 20, 2011

(65) Prior Publication Data

US 2011/0291386 A1 Dec. 1, 2011

(30) Foreign Application Priority Data

May 26, 2010 (FR) ..... 10 02202

(51) Int. Cl.
*A63C 9/081* (2012.01)
*A63C 5/00* (2006.01)
*A63C 9/00* (2012.01)

(52) U.S. Cl.
USPC ..... 280/618; 280/607; 280/613; 280/620

(58) Field of Classification Search
USPC ..... 280/607, 613, 611, 618, 620
See application file for complete search history.

(56) References Cited

U.S. PATENT DOCUMENTS

| | | | | |
|---|---|---|---|---|
| 3,734,520 | A * | 5/1973 | Hashioka | 280/632 |
| 3,930,660 | A * | 1/1976 | Frechin | 280/613 |
| 4,002,354 | A * | 1/1977 | Ramer | 280/614 |
| 4,029,336 | A * | 6/1977 | Haimerl | 280/614 |
| 4,392,666 | A * | 7/1983 | Ramer | 280/614 |
| 4,417,749 | A * | 11/1983 | Napflin | 280/614 |
| 4,602,804 | A * | 7/1986 | Spitaler et al. | 280/632 |
| 4,674,766 | A * | 6/1987 | Ramer | 280/614 |
| 4,718,694 | A * | 1/1988 | Brice et al. | 280/605 |
| 5,318,320 | A * | 6/1994 | Ramer | 280/614 |
| 5,326,127 | A * | 7/1994 | Mercat et al. | 280/632 |
| 5,344,180 | A * | 9/1994 | Lancon et al. | 280/625 |
| 5,560,633 | A * | 10/1996 | McGowan | 280/614 |
| 5,722,681 | A * | 3/1998 | Merino et al. | 280/634 |
| 6,308,979 | B1 * | 10/2001 | Ludlow | 280/615 |
| 6,431,578 | B2 * | 8/2002 | Pedersen et al. | 280/626 |
| 6,457,735 | B2 * | 10/2002 | Merino | 280/607 |

(Continued)

FOREIGN PATENT DOCUMENTS

| | | |
|---|---|---|
| DE | 10 2007 038 506 A1 | 2/2009 |
| EP | 1 498 993 A1 | 1/2005 |

(Continued)

*Primary Examiner* — J. Allen Shriver, II
*Assistant Examiner* — James M Dolak
(74) *Attorney, Agent, or Firm* — Greenblum & Bernstein, P.L.C.

(57) ABSTRACT

Safety binding for the practice of ski touring, including a baseplate having a rear end and a front end, the baseplate being adapted to be pivotally mounted relative to a ski; a rear base adapted to be fixed to the ski; a heel lift capable of taking at least a support position in which the heel lift limits the rotation of the baseplate, and a storage position in which the heel lift does not limit the rotation of the baseplate; and a mechanism enabling the baseplate to be alternatively fixed to and released from the rear base. The mechanism includes a locking device capable of switching from a first closed position to a second open position. The binding also includes a release member having an actuation surface adapted to be manipulated by the user, the bias of the actuation surface thereof driving the locking device toward the second open position; and a return member biases the locking device toward their first closed position. The first closed position of the locking device is the only stable position of the mechanism.

20 Claims, 6 Drawing Sheets

(56) References Cited

U.S. PATENT DOCUMENTS

| | | | | |
|---|---|---|---|---|
| 7,073,812 | B2 * | 7/2006 | Rigal et al. | 280/611 |
| 7,234,889 | B2 | 6/2007 | Gautier | |
| 7,246,812 | B1 * | 7/2007 | Ayliffe | 280/615 |
| 7,396,037 | B2 * | 7/2008 | Walker et al. | 280/614 |
| 7,735,851 | B2 * | 6/2010 | Shute et al. | 280/614 |
| 7,900,951 | B2 * | 3/2011 | Farges | 280/623 |
| 8,181,985 | B2 * | 5/2012 | Mangold et al. | 280/614 |
| 2007/0170695 | A1 * | 7/2007 | Damiani et al. | 280/617 |
| 2008/0116663 | A1 * | 5/2008 | Gyr | 280/611 |
| 2008/0197607 | A1 * | 8/2008 | Merino | 280/617 |
| 2008/0309053 | A1 | 12/2008 | Mangold et al. | |

FOREIGN PATENT DOCUMENTS

| | | | |
|---|---|---|---|
| EP | 1 559 455 | A1 | 8/2005 |
| EP | 2 030 658 | A1 | 3/2009 |
| EP | 2 172 251 | A2 | 4/2010 |
| WO | WO-2007/060219 | A1 | 5/2007 |
| WO | WO-2008/125363 | A2 | 10/2008 |

* cited by examiner

SAFETY BINDING FOR SKI TOURING

CROSS-REFERENCE TO RELATED APPLICATION

This application is based upon French Patent Application No. 10.02202, filed May 26, 2010, the disclosure of which is hereby incorporated by reference thereto, and the priority of which is hereby claimed under 35 U.S.C. §119.

BACKGROUND

1. Field of the Invention

The invention relates to safety bindings for skiing, more particularly safety bindings intended for the practice of ski touring.

2. Background Information

A binding of the aforementioned type must enable the boot to rotate about a transverse axis relative to the ski, located at the front of the boot, when skiing uphill, so that the heel of the user can move away from the ski so that an optimal thrust force can be exerted. Such a binding must also make it possible to dampen substantial torsional forces between the boot and the ski when skiing downhill.

An example of a safety ski touring binding is disclosed in the document DE102007038506. This safety binding is a baseplate, carrying the boot, which is pivotally mounted on the ski at the front and provided at the rear with detachable means for connecting to the ski. This safety binding is adapted to be used with rigid alpine ski boots that are attached to the pivotable baseplate. A toe piece and a heel piece are fixed to the baseplate in order to allow the boot to be retained or, when necessary, releasing it. In the ascent position, the pivotable plate is released from the ski at the rear in order to enable the boot to pivot relative to the ski. A heel lift capable of taking various positions is also provided. In the descent position, the pivotable baseplate is affixed to the ski in order to allow skiing using alpine downhill skiing techniques. Such a binding does not allow one to easily switch from the ascent position to the descent position. Indeed, to switch from the ascent position to the ski position, one must first ensure that the heel lift is in a storage position which does not block the rotation of the baseplate, and then, after setting the baseplate in the low position, one must maneuver the control lever to actuate the locking means. If the heel lift is in the high position at the start of the maneuver, it is necessary to carry out two separate, successive manipulations in order to switch from the ascent position to the descent position.

Another example of a ski touring binding is provided by the document EP1498993, in which the locking means of the baseplate and the heel lift are integral in a single piece. Although such a device can have an advantage in terms of weight, the same is not true in terms of efficiency and performance. Firstly, the disadvantage of the binding described in the previous paragraph is also found in this document. Indeed, to switch form the ascent position to the descent position, one must maneuver the heel lift once, set the baseplate in the low position, and then maneuver the heel lift again to lock. Furthermore, due to the locking means being positioned far to the rear, the forces are poorly transmitted between the user and the ski.

Another example of ski touring binding is given in FIGS. 1 to 6 of the document WO2007/060219, in which the control of the locking means is positioned beneath the boot, so that it is necessary to release the boot from the bindings in order to switch from the ascent position to the descent position. This constitutes a major drawback, because a binding of this type is often used in areas where powdery snow is abundant, and it may be difficult to put the skis back on. In addition, during the ascent on a low gradient slope in powdery snow, the back and forth movement of the baseplate causes the snow to pack in a certain area of the binding. This phenomenon, commonly referred to as a "wedge of snow", is a major hindrance in this type of binding. The packed snow hardens into ice and is particularly difficult to remove from the hard-to-reach areas, such as around the locking means, for example. However, switching the binding into the descent position is only possible after the snow has been completely removed. It is to be understood that the time required to switch from the ascent position to the descent position with such a product may be particularly long. Furthermore, a binding of this type is practically cumbersome and considerably weighs down the ski.

A description of the problems associated with existing safety bindings is not complete without including the problem relating to the time necessary to switch from the descent position to the ascent position, and especially from the ascent phase to the descent phase being more than a matter of comfort for the user. Indeed, it is a safety issue. This is particularly true because an off-piste skier, more frequently than other skiers, needs to move quickly in leaving his/her location in the case of an avalanche, for example.

Therefore, there is a need for an arrangement to connect the baseplate to the ski that is easy to handle, or manipulate, when switching to the ascent position or to the descent position. There is also a need for a connecting device that optimizes the transmission of forces between the boot and the ski and is substantially rigid in the descent position. The binding must be capable of providing a rigid and solid connection of the boot to the ski and must be sufficiently strong to withstand the forces generated during ski touring, while being sufficiently lightweight.

SUMMARY

The invention solves one or more of the aforementioned technical problems. In this regard, the invention relates to a safety binding structured and arranged for the practice of ski touring, including:

- a baseplate having a rear end, and a front end structured and arranged to be pivotally mounted relative to a ski;
- a rear base adapted to be fixed to the ski;
- a heel lift capable of taking at least a support position, in which the heel lift limits the rotation of the baseplate, and a storage position in which the heel lift does not limit the rotation of the baseplate;
- a mechanism enabling the baseplate to be alternatively fixed to and released from the rear base, this mechanism including:
  - a locking device capable of switching from a first closed position to a second open position;
  - a release member having an actuation surface adapted to be manipulated by the user, a force of the actuation surface driving the locking device toward the second open position;
  - a return member biasing the locking device toward the first closed position.

The invention also relates to a safety binding for ski touring which, in addition to the features listed hereinabove, has any technically acceptable combination of the characteristics listed below:

- the binding can be set alternatively in two stable states, the first stable state corresponding to a position of downhill skiing, in which the locking device is in the closed position and retains the rear end of the baseplate, the heel lift being in the storage position; whereas the second stable state corresponds to a slope climbing position, in which the heel lift is in the support position;

when the binding is in the ascent position, the locking device is in the closed position;

to switch from the ascent position to the descent position, the user needs to perform only one manipulation that involves switching the climbing wire from the support position to the storage position;

to switch from the descent position to the position ascent, the user needs to carry out two manipulations that involve exerting a force on the release member and switching the heel lift from the storage position to the support position;

the locking device includes a cam surface enabling the baseplate to be fixed automatically on the rear base;

the baseplate includes at least one shaft extending transversely, and in which the locking device includes at least one hook being disconnected from the shaft in its second position and capable of connecting to the shaft in its first position;

the hook includes a lower contact surface for vertically retaining the shaft to which it is connected, the lower contact surface being axially inclined relative to the sliding axis of the gripping member;

the hook includes an upper contact surface that is axially inclined, so that pressure from the shaft on the contact surface pushes the gripping member back towards its second position in order to allow its connection to the hook;

the locking device includes at least two hooks arranged on both sides of a longitudinal vertical median plane of the base;

the locking device includes at least two hooks axially offset with respect to one another;

the locking device is arranged so as to be substantially plumb with the heel piece when the connecting member is fixed to the base.

Due to the particular configuration of the ski touring binding according to the invention, a user can easily switch from an ascent position to a descent position, without breaking the connection between the boots and the skis. For example, a particularly interesting advantage of the invention lies in that the switch from the ascent position to the descent position occurs automatically as soon as the user sets the heel lift in the storage position.

BRIEF DESCRIPTION OF DRAWING

Other characteristics and advantages of the invention will be more apparent from the description that follows, with reference to the annexed drawings illustrating, by way of non-limiting embodiments, how the invention can be embodied, and in which.

DETAILED DESCRIPTION

The invention provides a safety binding for the practice of ski touring. The binding includes a connecting member pivoting in relation to the ski. A mechanism makes it possible to alternatively set or release the rear portion of the connecting member and a base fixed to the ski.

Thus, a very simple kinematics to be implemented by the user makes it possible to switch the binding from the ascent position to the descent position. Such a mechanism provides a simple and compact structure that is easy to adjust.

Figure 1:
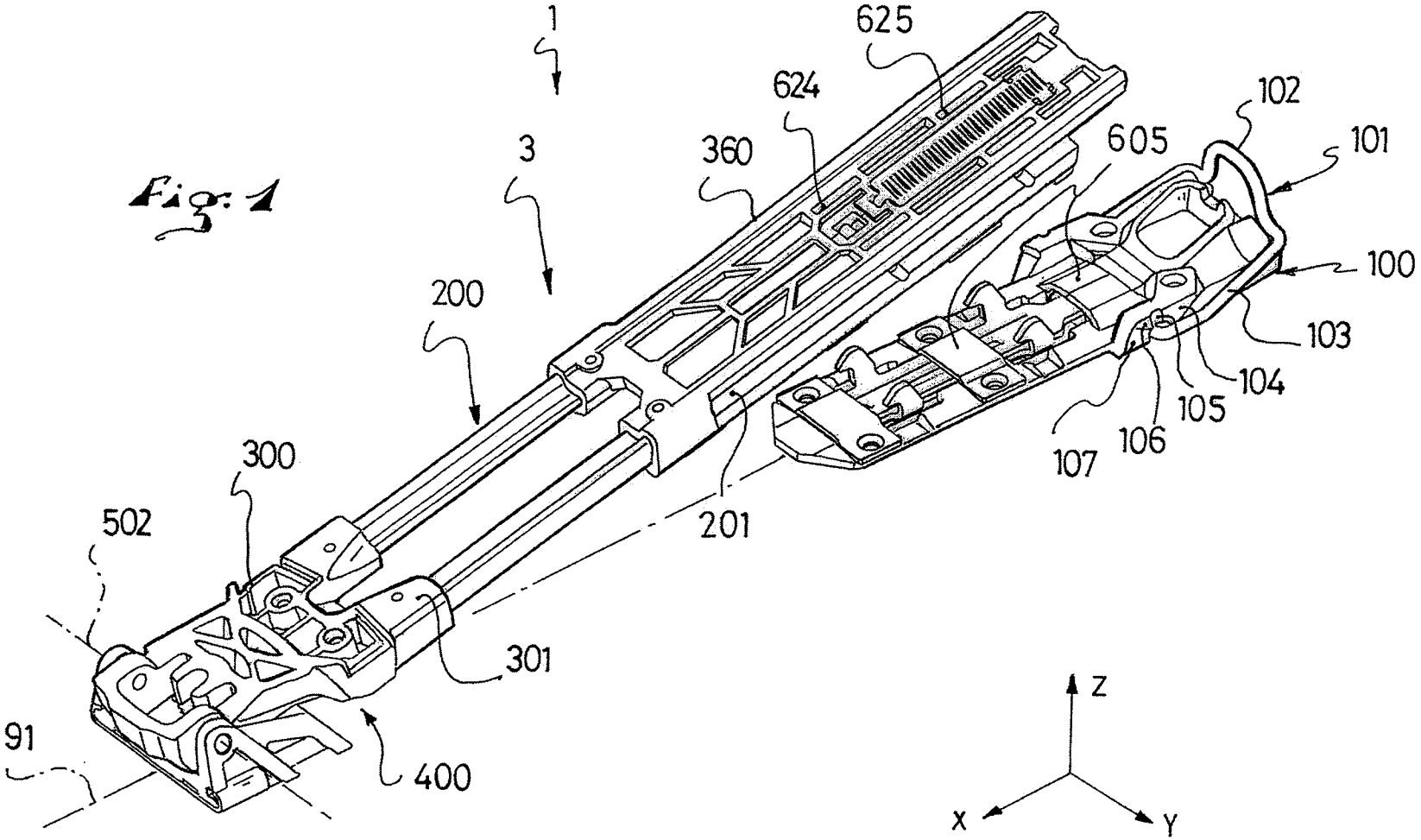
FIG. 1 is a perspective view of a safety binding portion according to an embodiment of the invention.

The following referential numbering, appearing in FIG. 1, is used throughout the description. The X-direction corresponds to the axial direction of the ski along which the binding is mounted. The Y-direction corresponds to the transverse direction in relation to the ski, and the Z-direction corresponds to the vertical direction in relation to the ski.

FIG. 1 is a perspective view of the main components of a safety binding 1 for the practice of ski touring. The binding 1 includes a front base 400, a baseplate 3, and a rear base 100.

The baseplate 3 is comprised of a toe piece baseplate 300, a connecting member 200, and a heel piece baseplate 360. The baseplate 300 constitutes the front portion of the baseplate 3 and is adapted to receive a toe piece 7 of any known type, shown in FIG. 4. The heel piece baseplate 360 constitutes the rear portion of the baseplate 3 and is adapted to receive a heel piece 8 of any known type, shown in FIG. 4.

The front 400 and rear 100 bases are adapted to be rigidly fixed to a ski 9. The baseplate 3 is pivotable in relation to the front base 400 about a Y-direction axis. To this end, the baseplate 3 is rotationally mounted via the toe piece baseplate 300 about an axis 502 extending between two surfaces of a stirrup of the base 400. The base 400 thereby provides a pivot structure, or connection, for mounting the baseplate 300 for pivoting in relation to the ski.

The toe piece baseplate 300 is fixed to the front end of the connecting member 200. The baseplate 300 has a support 301 for the sole of the user's ski boot. The heel piece baseplate 360 is fixed to the connecting member 200, in the area of its rear end. The toe piece baseplate 300 and the heel piece are thus axially offset to allow insertion of the user's boot. The toe piece baseplate 300 and heel piece baseplate 360 conventionally make it possible to vertically maintain the user's boot when it is inserted into the binding. The axial position of the heel piece in relation to the heel piece baseplate 360 can be adjusted in a known manner. To this end, the heel piece baseplate 360 has a rail 201 enabling the heel piece to slide axially, and an indentation 361 (see FIG. 4) for immobilizing the axial position of the heel piece via a known mechanism incorporated in the heel piece.

The binding 1 also includes a heel lift 101, which is fixed to the base 100.

The heel lift 101 is used when the binding 1 is in the ascent position, in order to provide a raised support, with respect to the base 100, for the heel of the user. The heel lift 101 is pivotally mounted about a Y-direction axis, via arms 103. The arms 103 are connected by a stop portion 102, or abutment portion, structured and arranged to form the support for the rear portion of the baseplate 3. In the area of each arm 103, the rear base has a first projection 104, a first recess 105, a second projection 106 and a second recess 107. During the pivotal travel of the heel lift 101, the arms 103 are initially deformed elastically when passing in engagement over the projection 104. The projection can also be referred to as an enlargement or boss. When the arms 103 reach the first recess 105, or depression, the heel lift 101 is stably maintained between the projections 104 and 106 in a first support position substantially perpendicular to the plane (X, Y). This first position is called the high position of the heel lift. When the pivotal travel of the heel lift 101 is continued, the arms are elastically deformed when passing in engagement over the projection 106. When the arms 103 reach the recess 107, or depression, the heel lift 101 is stably maintained in a second support position. In this position, i.e., the low position of the heel lift 101, the stop portion 102 can rest, in support, on the rear base 100.

In FIG. 1, the heel lift is shown in the storage position. When the binding is in the descent position, the heel lift is necessarily in this position.

In the position shown in FIG. 1, the rear end of the baseplate 3 is detached from the rear base 100 in order to enable the user's foot to pivot in relation to the ski.

A mechanism 600 enables the base 100, selectively, to be fixed to or released from the rear portion of the baseplate 3. The operation of this mechanism is described, next, with reference to FIGS. 2 and 3, which are partial cross-sectional views. The mechanism 600 includes a locking device which includes hooks 602 and 603. The hooks 602 and 603 form a gripping member affixed to the base 100. The hooks 602 and 603 are integral with, such as, e.g., unitary or in one piece with, a connecting rod 601 that is mounted to slide axially in relation to the base 100. The connecting rod 601, such as a thin plate, is mounted to slide in relation to the base 100 via one or more small arches 605 affixed to the base 100 and extending over the median portion of the connecting rod 601. Via the connecting rod 601, the hooks 602 and 603 are mounted to slide axially in relation to the base 100, between a first position and a second position. A return member 610, shown as a compression spring, biases the connecting rod 601 forward, that is to say, so that the hooks are placed in the first position.

Figure 2:
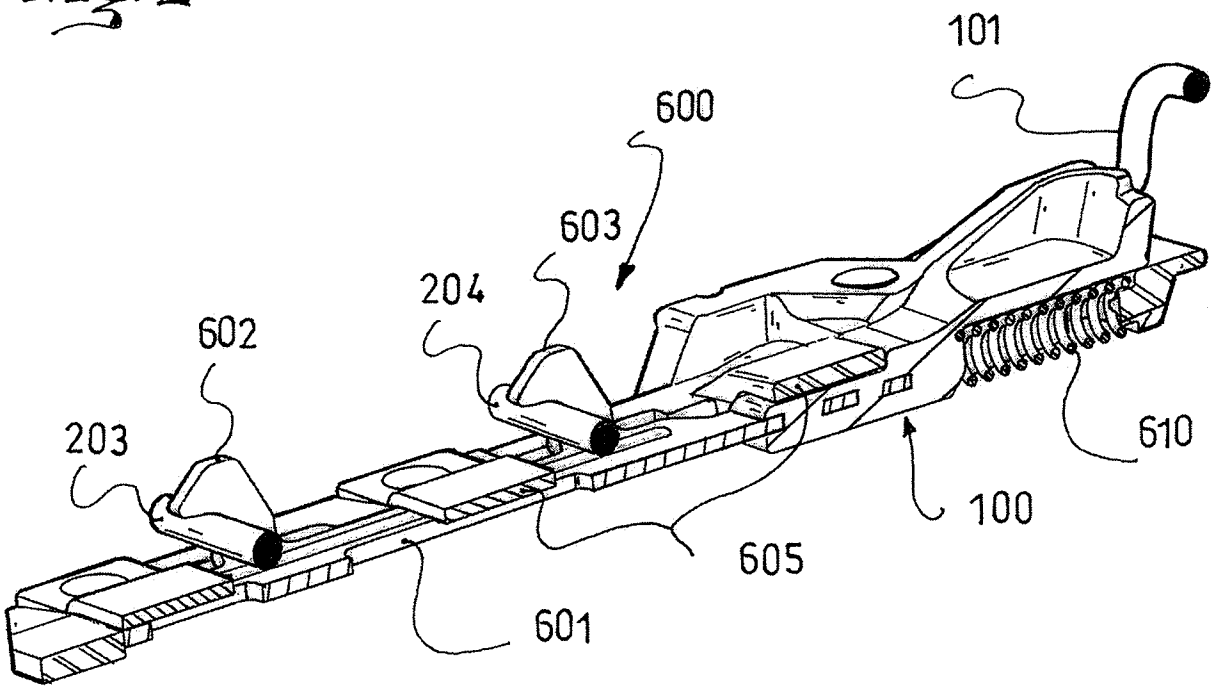
FIGS. 2 and 3 are perspective cross-sectional views of the rear base of the safety binding shown in FIG. 1, in two different states.

In the first position illustrated in FIG. 2, the hooks 602 and 603 are in the advanced position, which corresponds to a closed position of the mechanism 600. In the second position illustrated in FIG. 3, the hooks 602 and 603 are in the retracted position, which corresponds to the open position of the mechanism 600.

Given the presence of the return member 610 and the fact that there is no other mechanism to counteract the effect thereof, the stable position or resting position of the hooks is that in which the hooks are in the advanced position (see FIG. 1). In other words, the locking device is always automatically in the closed position, except when the user exerts a force to counter the return member. The first closed position of the locking device is the only stable position of the mechanism 600.

Figure 4:
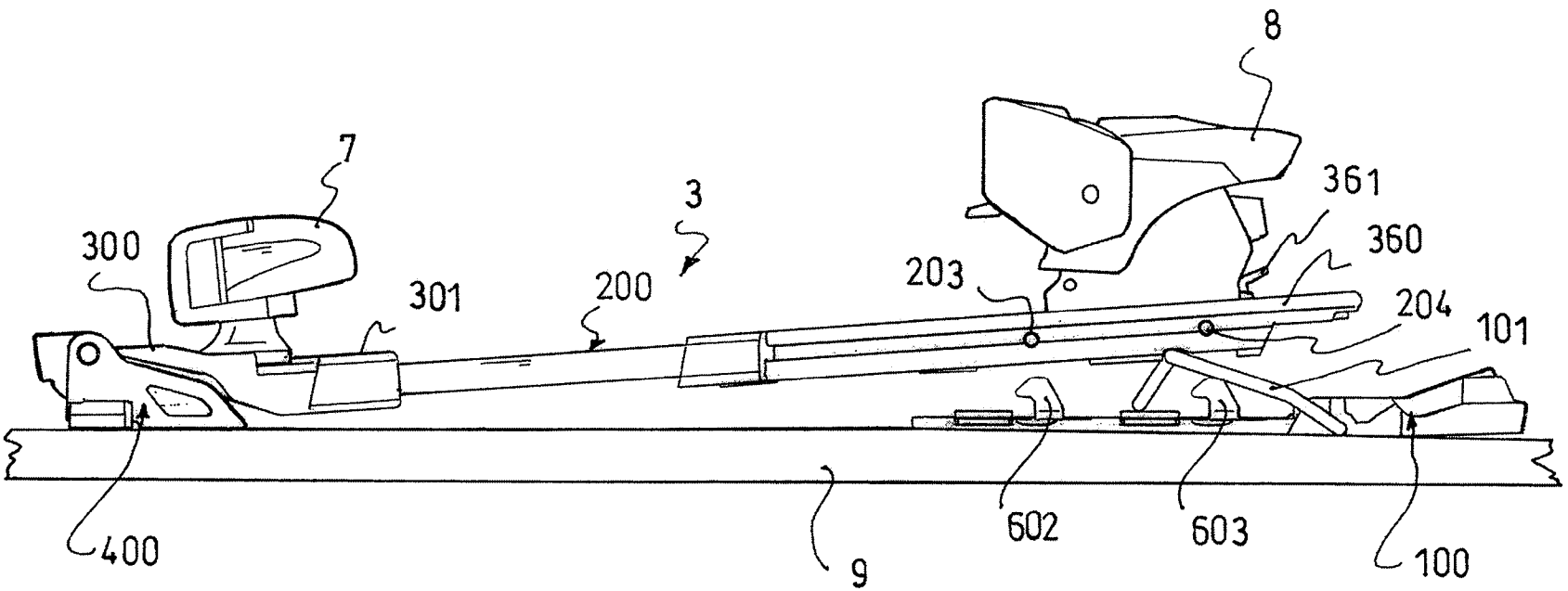
FIGS. 4 and 5 are side views of the safety binding of FIG. 1, mounted on a ski in two ascent positions.
Figure 5:
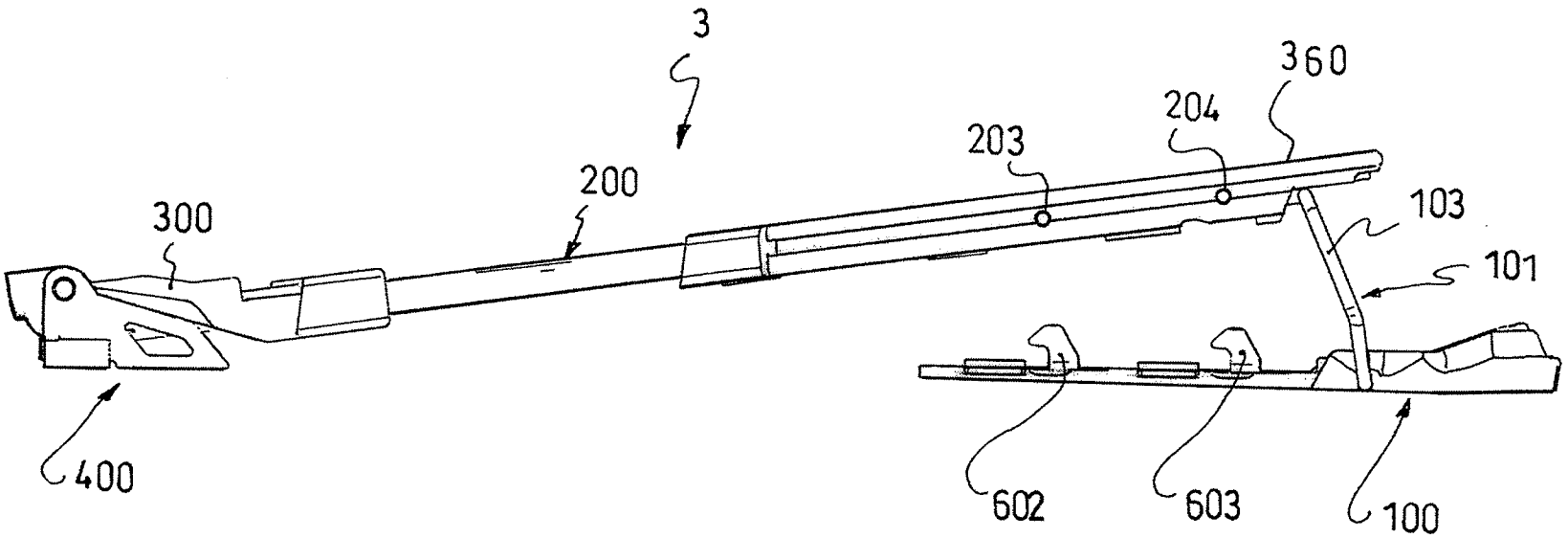

Rods 203 and 204 are fixed transversely beneath the heel piece baseplate 360. The lateral ends of the rods are shown in FIGS. 1, 4 and 5. The rods 203 and 204 are arranged so as to be substantially plumb with the hooks 602 and 603, respectively. The heel piece baseplate 360 has openings 624 and 625, shown in the form of elongated slots in FIG. 1, arranged so as to be plumb with the hooks 602 and 603. The openings 624 and 625 enable the hooks 602 and 603 to slide relative to the connecting member 200, when the latter is pressed against the base 100.

In FIG. 2, the hooks 602 and 603 are in the first position, i.e., the advanced position. The rear end of the baseplate 3 is pressed against the base 100. For a better understanding, the rods 203 and 204 are shown in this view. As shown, the hooks 602 and 603 are coupled to the rods 203 and 204, such that the rear portion of the baseplate 3 is fixed to the base 100. The foot of the user then cannot pivot relative to the ski. The binding 1 is then the descent position.

Figure 3:
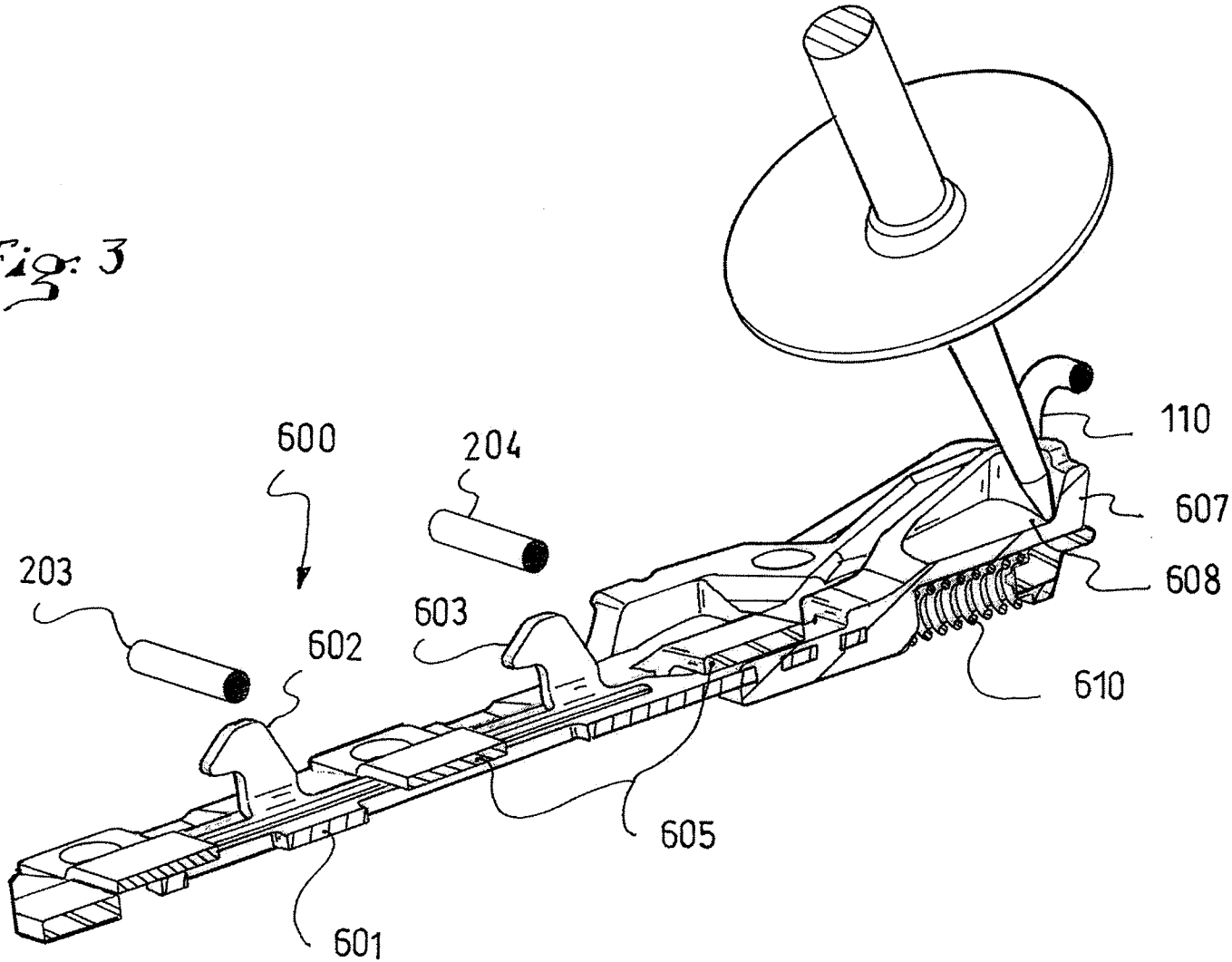

In FIG. 3, the user, using a ski pole, exerts pressure on the actuation surface 608 of the release member 607. The release member 607 is an element that is affixed to the connecting rod 601 and is used for manipulating the connecting rod. Thus, the release member 607 and the locking device, i.e., the hooks 602 and 603, form a unitary subassembly, i.e., a one-piece assembly, with no relative movement between the constituent elements. The release member, in a particular embodiment, is a plastic element overmolded on the connecting rod 601, which, in such embodiment, is made of steel. This is a non-limiting exemplary embodiment. The pressure on the release member 607 results in the hooks 602 and 603 moving back into their second position, i.e., the retracted position. In this position, the hooks 602 and 603 no longer retain the rods 203 and 204, so that the rear portion of the baseplate 3 can be released from the base 100. The baseplate 3 can thus pivot relative to the front base 400. The binding 1 can be placed in the ascent position.

According to this embodiment, the action enabling the release of the baseplate 3 from the base 100 involves displacing the release member 607, and therefore the locking device, i.e., the hooks 602, 603, translationally along an axial direction of the ski. This action is simple and straightforward, and does not require any particular kinematics in order to act on the locking members. There is no transformation of actuating movement. The mechanism 600 is simple and less expensive to produce because the number of parts is reduced.

In order to place the binding in the ascent position effectively, the user must position the heel lift 101 in one of its two support positions.

FIG. 4 shows the binding in the ascent position, with the heel lift 101 placed in the low support position. Although the hooks 602 and 603 have returned to the closed position, due to the action of the return member 610, the interlocking of the hooks and rods cannot occur because the downward travel of the baseplate is prevented by the heel lift 101.

FIG. 5 shows the binding in the ascent position, with the heel lift 101 set in the high support position.

In the illustrated embodiment, the heel lift has two support positions. This is not limiting to the scope of the invention, however, because the invention embraces a heel lift having a greater number of support positions, including a support position lower than that shown in FIG. 1.

When the mechanism 600 is in one of the configurations of FIGS. 4 and 5, the skier can climb a slope with the skis secured to his or her feet. At the end of the ascent, in order to reengage in the descent position, the skier only needs to carry out the following two steps, alternately for the right foot and the left foot:

raising the right heel, and then the left heel; and simultaneously pivoting the heel lift 101 rearward, using the ski pole, until the heel lift occupies its storage position, FIG. 1 showing the ski binding at the end of this step;

lowering the heel until engaging the locking device, FIG. 1 showing the mechanism 600 at the end of this step.

Although the switch from the ascent position to the descent position occurs in two steps, the invention provides the advantage that the switch, or change, requires only one manipulation from the user, i.e., that of switching the heel lift from one of the support positions to the storage position. Indeed, because this maneuver can be performed while the skis are on the user's feet, the action of raising or lowering the rear end of the baseplate is not a manipulation.

At the end of the descent, in order to climb the slope again, the skier performs the following two steps:

pressing on the release member 607, using the ski pole, in order to counter the bias of the return member 610, and simultaneously lifting the right heel, and then the left heel, FIG. 3 showing the mechanism 600 at the end of this step;

pivoting the heel lift 101 forward until it occupies one of its support positions, as shown in FIGS. 4 and 5.

Switching from the descent position to the ascent position requires two successive manipulations: one of the release member 607, and the other of the heel lift 101.

The switch between the ascent and descent positions can thus be achieved simply by using a mechanism 600 having a structure that is both simple and lightweight. Further, it is to be understood, using the ski binding is very easy, even when the user keeps the skis on his or her feet.

In general, the safety binding according to the invention is particularly advantageous because the locking device is always in the closed position, i.e., with the hooks advanced forward. Moreover, the systematic use of the heel lift results, in the ascent position, in a gap being maintained between the baseplate 3 and the rear base 100, so that a wedge of packed snow does not form between these two elements. The combination of these two characteristics promotes a very quick switch from the ascent position to the descent position. Therefore, the safety binding of the invention provides increased security over existing safety bindings.

In the storage position, the heel lift 101 advantageously forms a small arch surrounding the release member 607. The arch of the heel lift 101 makes it possible to prevent a switch to the ascent position following an accidental support on the release member 607. The arch also makes it possible to guide the end of a pole toward the release member 607 in order to make the switch to the ascent position. The release member 607 is advantageously inclined in relation to the plane (X, Y), with an inclination about the Y axis, so that the user can apply an axial force enabling the switch to the ascent position.

The heel piece 8 is advantageously arranged so as to be substantially plumb with the rods 203 and 204, irrespective of the axial position of the heel piece relative to the baseplate 3. Thus, in the descent position, the forces exerted on the heel piece are transmitted directly to the base 100 and to the ski. The precision in guiding the ski is thus improved, and bending the baseplate 3 is avoided.

In the illustrated embodiment, the shafts 203 and 204 are axially offset and the hooks 602 are axially offset relative to the hooks 603. Thus, the transmission of forces from the heel piece to the base 100 is improved, and the bending of the baseplate 3 is further reduced in the descent position. Moreover, the axial forces exerted by the heel piece are distributed along the length of the base 100.

In the example illustrated, the binding 1 includes hooks 602 and 603 on both sides of the median axis 91 of the ski 9 or of the longitudinal vertical median plane of the base 100. Thus, the binding 1 has better torsional rigidity about the axis of the ski in the descent position.

The hooks 602 and 603 are advantageously housed in the openings 624 and 625 in order not to project from the upper surface of the heel piece baseplate 360. Thus, the hooks 602 and 603 do not interfere with the sole of a boot maintained in the binding 1 in the descent position.

Figure 6:
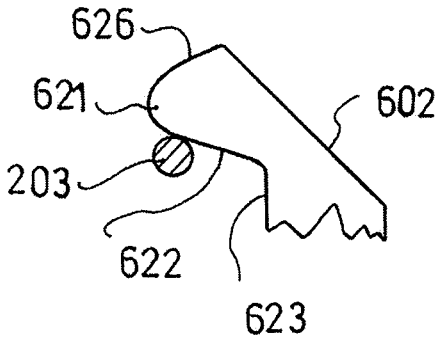
FIGS. 6 and 7 are cross-sectional side views of the locking device during various locking phases.
Figure 7:
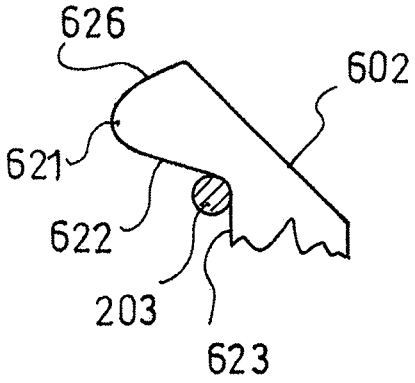

FIGS. 6 and 7 are cross-sectional side views of an alternative hook, respectively at the beginning and the end of its coupling to a rod. The hook 602 has a lower guiding surface 622 for guiding the rod 203 up to an axial stop surface 623. The free end 621 of the contact surface is rounded to facilitate the beginning of the coupling illustrated in FIG. 6. Moreover, the lower guiding surface 622 has an inclination about the Y-axis. The guiding surface 622 is thus inclined in relation to the plane (X, Y), in which the sliding axis of the connecting rod 601 and of the hook 602 is located. Thus, during the travel of the hook 602, the possible clearance between the hook 602 and the rod 203 is gradually taken up and the rod 203 is gradually pulled downward until reaching the position in which it is in contact with the stop surface 623. Because this traction on the rod 203 causes an elastic deformation of the binding 1, a vertical contact force is constantly maintained between the hook 602 and the rod 203, which eliminates the clearance when using the binding 1 in the descent and thus guarantees high accuracy in guiding the ski.

Furthermore, the locking device includes a cam surface enabling the baseplate 3 to be locked automatically on the rear base 100. This cam surface is formed by the upper guiding surface 626 of each hook. When switching from the ascent position to the descent position, at the time the baseplate 3 comes back down, the hook 202, as soon as the rod 203 comes into contact with its upper guiding surface 626, is pushed backward (toward the open position of the locking device). Due to the action of the return member, the contact between the rod 203 and the hook 202 is maintained, and the rod 203 slides until reaching the guiding surface 622. The return of the connecting rod 601 to its first position then ensures the coupling between the rod 203 and the hook 602.

As explained above, the automatic locking of the baseplate 3 on the rear base 100 is obtained by combining two features of the mechanism 600: the cam surface 626 of the hooks 602, 603 of the locking device, on the hand, and the return member 610 bringing the locking device back into the closed position, on the other hand. This automatic locking is convenient for the user because, by simply lowering the baseplate 3, the user can lock it with the rear base 100. The weight of the foot is sufficient. Of course, the heel lift must first be retracted.

The hooks 603 can have a shape similar to that of the hooks 602, in order to be coupled to the shaft 204 in the same way.

The invention is not limited to the particular embodiments and examples described and illustrated, but encompasses any equivalent embodiments.

In addition, the invention illustratively disclosed herein suitably may be practiced in the absence of any element which is not specifically disclosed herein.

The invention claimed is:

1. A ski touring safety binding for a shoe or boot of a skier, said binding comprising:

a baseplate having a rear end and a front end;

a pivot connection to mount the baseplate for rotation in relation to a ski;

a rear base structured and arranged to be fixed to the ski;

a heel lift structured and arranged to be placed in at least one of a support position and a storage position, in the support position the heel lift limiting the rotation of the baseplate and in the storage position the heel lift not limiting the rotation of the baseplate;

a mechanism structured and arranged to enable the baseplate to be selectively fixed to or released from the rear base, said mechanism comprising:

a locking device structured and arranged to switch between a first closed position and a second open position;

a release member having an actuation surface structured and arranged to be manipulated by the skier to apply a force to the actuation surface driving the locking device toward the second open position;

a return member structured and arranged to bias the locking device toward the first closed position;

the first closed position of the locking device being the only stable position of the mechanism.

2. A binding according to claim 1, wherein:

the binding is structured and arranged to be alternately set in either of two stable binding states, said two stable binding states comprising:

a first stable binding state, corresponding to a slope descent position, with the locking device being in the closed position retaining the rear end of the baseplate and the heel lift being in the storage position;

a second stable state, corresponding to a slope ascent position, with the heel lift being in the support position.

3. A binding according to claim 2, wherein:

the locking device is in the closed position when the binding is in the ascent position.

4. A binding according to claim 2, wherein:

only a single manipulation is required to be performed to switch the binding from the ascent position to the descent position, said single manipulation comprises a manipulation consisting of switching the heel lift from the support position to the storage position.

5. A binding according to claim 2, wherein:

two manipulations are required to be performed to switch the binding from the descent position to the ascent position, said two manipulations comprise exerting a force on the release member and switching the heel lift from the storage position to the support position.

6. A binding according to claim 1, further comprising:

a toe piece fixed to the baseplate, the toe piece being structured and arranged to engage a front of the shoe or boot of the skier; and and a heel piece fixed to the baseplate, the heel piece being structured and arranged to engage a rear of the shoe or boot of the skier.

7. A binding according to claim 1, wherein:

the locking device includes a cam surface structured and arranged to enable the baseplate to be fixed automatically on the rear base.

8. A binding according to claim 1, wherein:

the baseplate includes at least one shaft extending transversely;

the locking device includes at least one hook disengaged from the shaft in the second open position of the locking device and engaged with the shaft in the first closed position of the locking device.

9. A binding according to claim 8, wherein:

the hook is mounted to a connecting rod, the connecting rod structured and arranged to slide along an axis between the first closed position and the second open position of the locking device;

the hook includes a lower contact surface for vertically retaining the shaft, the lower contact surface being axially inclined in relation to the sliding axis of the connecting rod.

10. A binding according to claim 8, wherein:

the hook is mounted to a connecting rod, the connecting rod structured and arranged to slide along an axis between the first closed position and the second open position of the locking device;

the hook includes an upper contact surface axially inclined, so that pressure from the shaft on the contact surface pushes the connecting rod back to the second open position in order to allow engagement with the hook.

11. A binding according to claim 8, wherein:

the locking device includes at least two hooks arranged on both sides of a longitudinal vertical median plane of the rear base.

12. A binding according to claim 8, wherein:

the locking device includes at least two hooks axially offset with respect to one another.

13. A binding according to claim 1, further comprising:

a heel piece fixed to the baseplate, the baseplate being structured and arranged to be fixed against movement in relation to the rear base;

the locking device is structured and arranged to be substantially plumb with the heel piece when the baseplate is fixed in relation to the rear base.

14. A binding according to claim 1, wherein:

the binding is structured and arranged to be alternately set in either of two stable binding states, said two stable binding states comprising:

a first stable binding state, corresponding to a slope descent position, with the locking device being in the closed position retaining the rear end of the baseplate, and with the heel lift being in the storage position;

a second stable state, corresponding to a slope ascent position, with the locking device being in the closed position but not retaining the rear end of the baseplate, and with the heel lift being in the support position.

15. A binding according to claim 1, wherein:

the baseplate comprises two transversely extending shafts, said two shafts being axially offset with respect to each other;

the locking device comprises two hooks;

the two hooks being disengaged from respective ones of the two shafts in the second open position of the locking device and engaged with respective ones of the two shafts in the first closed position of the locking device.

16. A binding according to claim 1, wherein:

the locking device is biased into the first closed position by means of the return member;

in the second open position of the locking device, the mechanism is in an unstable position;

in said unstable position of the mechanism, the return member is structured and arranged to prevent the locking device from being maintained in the second open position.

17. A binding according to claim 1, wherein:

the locking device is structured and arranged to return automatically to the first closed position in an absence of a force countering the bias of the return member.

18. A ski touring safety binding for a ski boot, said binding comprising:

a boot-supporting baseplate structured and arranged to be mounted to a ski for movement allowing an alternate boot-heel raising and boot-heel lowering in relation to an upper ski surface during use of the binding;

a rear base structured and arranged to be fixed to the ski;

a heel lift structured and arranged to be placed in at least one of a support position and a storage position, in the support position the heel lift limiting the movement of the baseplate and in the storage position the heel lift not limiting the movement of the baseplate;

a mechanism structured and arranged to enable the baseplate to be selectively fixed to or released from the rear base, said mechanism comprising:

a locking device structured and arranged to switch the binding between a first closed position and a second open position, the baseplate being released from the rear base in the second open position of the locking device;

a release member having an actuation surface structured and arranged to be manipulated by the skier to apply a force to the actuation surface driving the locking device toward the second open position;

a return member structured and arranged to apply a return force to automatically move the locking device toward the first closed position in an absence of an opposing force greater than the return force;

no structure for applying an opposing force greater than the return force of the return member to thereby retain the locking device fixed in the second open position.

19. A binding according to claim 18, wherein:

the return member comprises a spring.

20. A binding according to claim 18, wherein:

the return member comprises a compression spring.

* * * * *